United States Patent [19]

Lonsmin

[11] Patent Number: 4,475,297

[45] Date of Patent: Oct. 9, 1984

[54] DECORATION FOR A NOVELTY

[76] Inventor: Victor Lonsmin, 1406 Ogden Ave., LaGrange Park, Ill. 60525

[21] Appl. No.: 380,570

[22] Filed: May 21, 1982

Related U.S. Application Data

[63] Continuation-in-part of Ser. No. 319,477, Nov. 9, 1981.

[51] Int. Cl.[3] ..... G09F 7/00

[52] U.S. Cl. ..... 40/486

[58] Field of Search ..... 273/155; 46/35, 36, 46/37; 272/8; 40/334, 335, 488, 486, 10 D

[56] References Cited

U.S. PATENT DOCUMENTS

| | | | |
|---|---|---|---|
| 2,264,194 | 11/1941 | Wuestman | 40/334 |
| 2,475,934 | 7/1949 | Wuestman | 40/334 |
| 4,073,612 | 2/1978 | Nitta | 40/10 D |
| 4,330,954 | 5/1982 | Losmin | 40/334 |
| 4,381,615 | 5/1983 | Losmin | 40/488 |

*Primary Examiner*—Gene Mancene
*Assistant Examiner*—Wenceslao J. Contreras
*Attorney, Agent, or Firm*—Gary, Juettner & Pyle

[57] ABSTRACT

Novelty ornamentation such as for a cover in the form of a non-disposable sleeve for a disposable cigarette lighter of conventional design is disclosed. A novelty appearing and disappearing image presenting assembly is situated on one side of the sleeve and includes a filmstrip enclosed in a housing. The filmstrip has opaque portion having a desired color providing a permanent portion of the image and a translucent portion providing the appearing and disappearing portion of the image. A dark background is permanently situated behind the translucent portion of the filmstrip and a light colored shield is selectively positionable behind the translucent portion in front of the dark background. The shield is movable by gravity to and from a position behind the translucent portion of the image on the filmstrip, thereby to cause it to appear when the shield is moved behind and to disappear when the shield is moved away. The novelty appearing and disappearing image presenting assembly can also be affixed to other novelty items than the lighter sleeve, such as directly to the cigarette lighter itself, a key chain fab, ornamental display, etc. In such instances, the image presenting assembly may be provided with an adhesive backing to hold it to the novelty.

28 Claims, 7 Drawing Figures

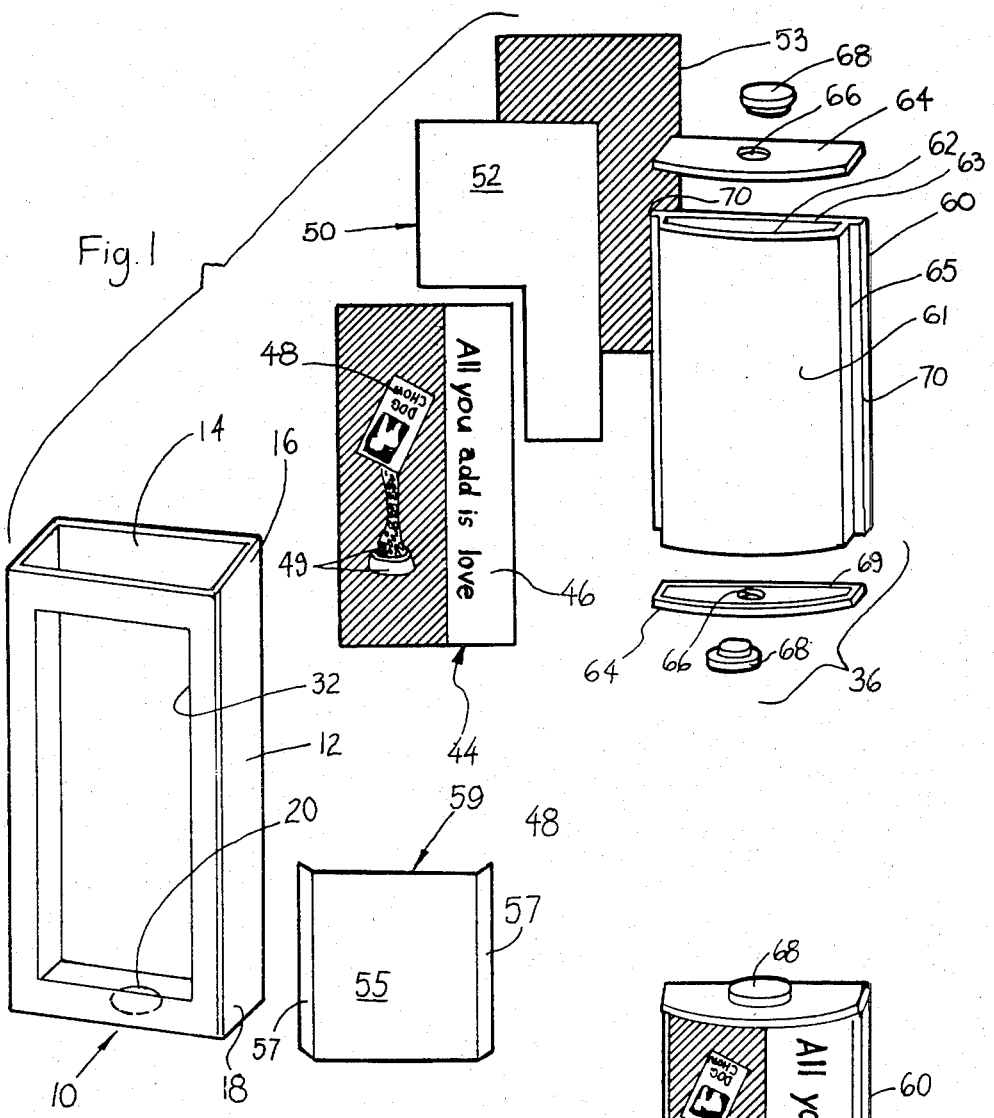
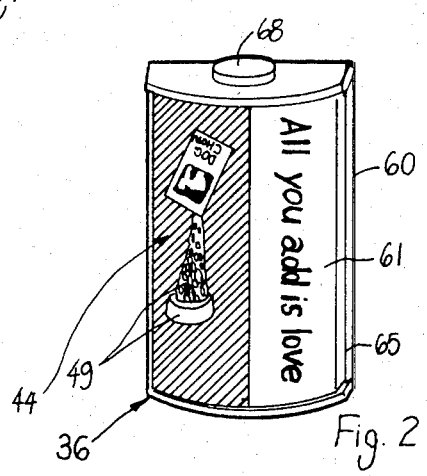
Fig. 2

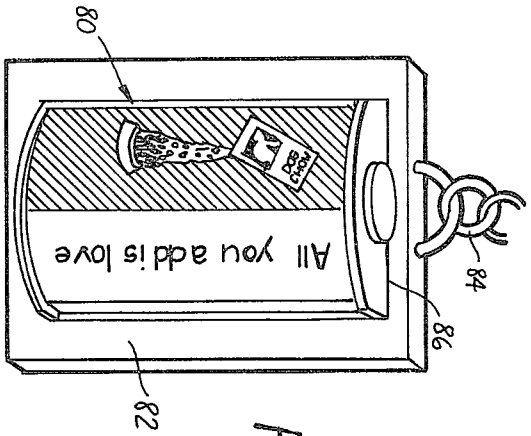
Fig.6
Fig. 7
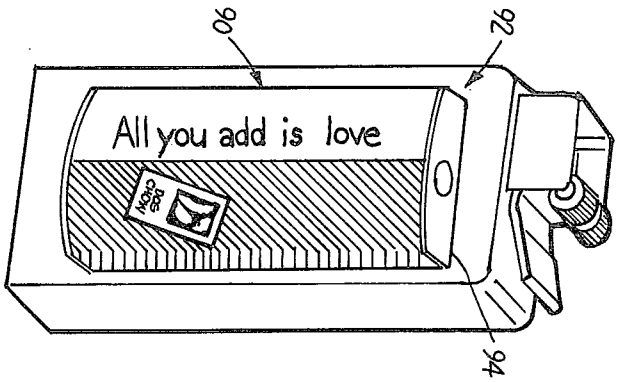

DECORATION FOR A NOVELTY

RELATED APPLICATIONS

This application is a continuation-in-part of my copending U.S. patent application Ser. No. 319,477 filed Nov. 9, 1981 entitled "Lighter Sleeve". In addition, this application relates to my copending U.S. patent application Ser. No. 239,660, filed Mar. 2, 1981, entitled "Lighter Cover".

FIELD OF THE INVENTION

The present invention relates to novelty decorations and to a decorative novelty sleeve or covering for a cigarette lighter or the like. More specifically, the present invention relates to an image presenting assembly for a novelty or sleeve for causing an image to appear and disappear.

DESCRIPTION OF THE PRIOR ART

Heretofore, the novelty writing instrument having an appearing and disappearing personal name has been invented. Such a novelty writing instrument is disclosed in U.S. Pat. No. 4,037,343 issued on July 26, 1977 to Victor Lonsmin.

Novelties, such as cigarette lighters of the disposable type have become very popular in the marketplace and are made inexpensively with little or no ornamentation since they are throw-away items.

SUMMARY OF THE INVENTION

The novelty decoration of the present invention is designed to provide a permanent cover and ornamentation for conventional, inexpensive novelties, such as throw-away cigarette lighters. Also, the novelty decoration on the sleeve individualizes the cigarette lighter for the owner thereof so that he or she can recognize a particular lighter as his or her lighter.

Also, the novelty, by having an appearing and disappearing image thereon becomes a conversational piece and provides entertainment for friends and guests of the owner thereof.

According to the invention there is provided a decoration for a novelty, such as a cigarette lighter or sleeve for a lighter, comprising a body portion having a hollow interior space sized to receive the body of a disposable cigarette lighter of conventional design, one end of said body portion being closed off to form a bottom end of said sleeve, the other end of said body portion being open to receive the cigarette lighter therein. The decorative image presenting means is contained in a housing which is provided on the novelty, such as on a side of said sleeve. The housing contains a filmstrip with opaque portions of said filmstrip having a desired color to provide a portion of an image and a translucent portion having the remaining portion of the image which is caused to appear and disappear, a dark background situated behind said translucent portion of the filmstrip and means for moving by gravity a light colored shield behind the filmstrip and in front of said dark background so as to enable the portion of the image defined by the translucent portion of the filmstrip to be caused to appear when the shield moves therebehind and to disappear when the shield is moved away. The housing may be affixed to the novelty by various means.

BRIEF DESCRIPTION OF THE DRAWINGS

FIG. 1 is an exploded, perspective view of the component parts of one embodiment of the present invention in the form of a sleeve or cover.

FIG. 2 is a perspective sub-assembly view of a portion of the components parts shown in FIG. 1.

FIG. 6 is a perspective view of the assembled components shown in FIG. 2 affixed to a key fab novelty.

FIG. 7 is a perspective view of the assembled components shown in FIG. 2 affixed directly to a cigarette lighter.

DESCRIPTION OF THE PREFERRED EMBODIMENTS

Figure 3:
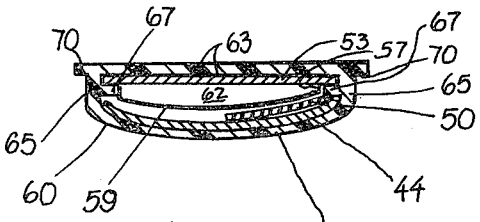
FIG. 3 is an enlarged cross-sectional view taken along the line 3—3 of FIG. 2.

Referring now to the drawings in greater detail, there is illustrated in FIG. 1 an exploded, perspective view of the novelty decoration of the present invention in the form of a cigarette lighter cover 10. The cigarette lighter cover 10 is in the form of a sleeve 12 having a hollow body portion 14, an upper open end portion 16, and a generally closed bottom portion 18. If desired, the closed bottom portion 18 can have an opening or hole 20 therein to provide a passage to accommodate the opening found on the bottom of some disposable cigarette lighters. A conventional disposable cigarette lighter (not shown in FIG. 1) is adapted to pass through end 16 and be received in body 14. Cover 10 is somewhat similar to that described in my copending U.S. patent application No. 239,660.

Figure 4:
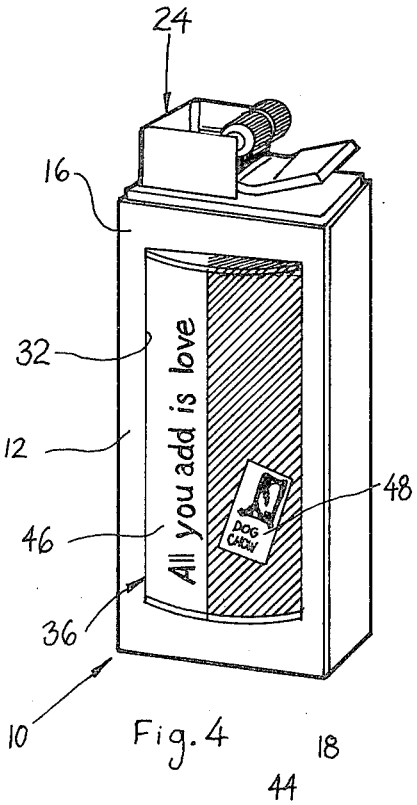
FIG. 4 is a perspective view of the assembled novelty of FIG. 1 with a cigarette lighter therein and showing one form of illusion.

As shown, the body portion 14 has a generally rectangular cross-section for receiving the cigarette lighter (not shown) which has a similar cross-section. Of course, the cross-section of the sleeve can be made to accommodate the cross-section of any lighter with which it is to be used. As shown in FIG. 4, the open end 16 is configured to mate with the conventional cigarette lighter 24. The sleeve 12 is made of a somewhat flexible material, like plastic, and sized to permit it to grip the lighter to retain the sleeve on the lighter.

Also, the sleeve 12 is provided with a large, rectangular window 32 on one side thereof which is adapted to receive an image presenting assembly or portion 36 shown in exploded view in FIG. 1, and in assembled view in FIG. 2.

As shown in FIGS. 1, 2 and 3, the image presenting assembly portion 36 includes a filmstrip 44, which in this instance carries a slogan 46, a product container 48 and a product being poured from the container into a dish, the latter two items being indicated by the reference numeral 49. As typical of filmstrips, the filmstrip 44 is translucent and an image thereon is caused to appear by presenting a light colored background behind the filmstrip. Accordingly, the assembly 36 further include a light background sheet 50 which has a backing surface 52 of a light color, such as white, and is adapted to be positioned behind the filmstrip 44. In this instance the light background 50 is provided behind only its slogan 46 and product container 48. A portion 58 of the light background that would have been behind the product being poured into the dish, indicated at 49, is cut away. Of course, the light background could also be painted or coated onto the back of the film 44 as by silk screening. When assembled behind the filmstrip 44, the background sheet 50 causes the slogan 46 and product 48 to always appear.

Assembly 36 also includes a dark color background sheet 53 of a dark color, such as black, which is positioned behind the filmstrip and light color background 50.

As will be described in greater detail hereinafter, the product being poured and dish, indicated as 49, will appear only when backed by a light color, otherwise they will appear dark due to the dark background sheet 53, giving the appearance of the features on the portion 49 of the filmstrip not being there at all.

To provide the light color backing for the image indicated by reference numeral 49, a movable shield 59 is provided between the filmstrip 44 and background 50. The shield 59 has a flat surface 55 and bent edges 57, may be made of a heavy material, such as brass, painted or coated white, and shaped when assembled to curve to fit closely to the filmstrip. The shield 59 is of such length that it is free to move in a vertical direction.

The image presenting assembly 36 has a clear, transparent window housing 60 made of a plastic material, such as clear Butyrate. The housing 60 has a hollow interior 62 formed by a curved front wall 61 and a back wall 63, and side walls 65 carrying ridges 67 (FIG. 3), and is sized to receive the filmstrip 44, background 50 and movable shield 59. In the form shown in FIGS. 1–5, the ends of the back wall 63 extend outwardly to form shoulders 70 for engaging margins of opening 32 to locate and hold the window housing 60 on the sleeve 12. The ends of the interior 62 are closed by upper and lower caps 64 made of clear Butyrate. The interior surfaces of caps 64 have protruding ledges 69 of triangular cross-section which help locate the cap on the housing 60. The caps 64 in turn have fill and vent openings 66 closed by compatible plugs 68. Preferably the caps 64 and plugs 68 are also made of clear Butyrate plastic.

In assembling the image presenting assembly 36, the light and dark color background sheets 50 and 53 and the filmstrip 44 are inserted into the interior of the window housing 60. The light color and dark backgrounds may be held in place spaced apart from each other by the two small ridges 67 provided on opposite sides 65 of the housing 60. The curved front wall 61 and side walls 65 of the housing 60 hold the filmstrip 44 tightly against the front wall of housing 60. The shield 59 is also put into the housing 60, the bent edges of the shield being guided by the ridges 67. The ends of the housing 60 are then closed by installing, as by gluing, the caps 64 in place. Then the assembly may be filled with a light oil to enhance the illusion by taking up any optical voids and slowing down the movement of the shield 59 in response to gravity. The oil also eliminates any sounds that would be caused by the shield falling too quickly. The oil may be introduced into the housing 60 through one of the openings 66 while a vacuum is applied to the other so as to facilitate filling and to minimize entrapment of air bubbles. Entrapped air bubbles would diminish the illusion. When filled with oil, the openings 66 are closed by the tight fitting plugs 68. If desired the plugs 68 may also be glued.

After being assembled, the window housing 60 containing the filmstrip 44, light and dark backgrounds 50 and 53, shield 59 and oil, may be snapped into place or otherwise secured, as by adhesive or interference fit, into the window 32 of the sleeve 12. This completes the assembly of the sleeve or cover, which is now ready to receive a conventional lighter.

Figure 5:
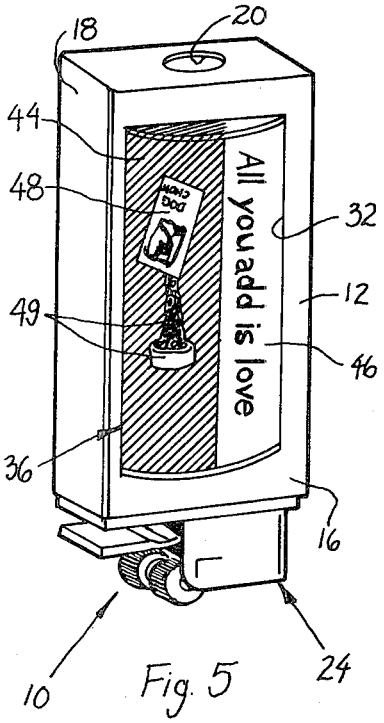
FIG. 5 is a perspective view of the assembled novelty sleeve of FIG. 1 with a cigarette lighter therein and showing another form of illusion.

Referring now to FIG. 4, the sleeve or cover of the present invention is shown with a conventional lighter 24 installed in place. It is apparent that when the shield 59 is down in a first relative position with respect to the housing 60 and sleeve 12, with its white surface thereof away from the cut away portion 58, the dark background 53 appears, and the product being poured and dish, indicated at 49, cannot be seen. The dark background 53 gives a similar appearance as that of the opaque portion of the film. Referring to FIG. 5, when it is desired to have the product being poured and dish to also appear, all that need be done is invert the lighter and cover so that the light color surface of the shield 59 is behind the product being poured and dish, indicated at 49.

Referring to FIG. 6, assembly 80, generally similar to assembly 36 of FIG. 2 is shown attached to a novelty in the form of a fab 82 for a key chain 84. The assembly in this instance is provided with an adhesive means, such as in the form of double-backed adhesive tape 86, to hold the assembly 80 to the novelty. Of course, if desired, the fab itself could have been provided with a window to hold the assembly 80 by snap fit, as in the manner shown in FIGS. 1–5.

Referring to FIG. 7, an assembly 90, generally similar to assembly 80 of FIG. 6 is shown attached directly to the novelty, a cigarette lighter 92. Again, like assembly 80, assembly 90 is provided with means for securing the assembly to the novelty, in this instance as by commercially sold contact cement for plastics, such being indicated at 94. In this form, the housing of the assembly is simplified as there are no side shoulders, like shoulders 70 shown in FIG. 3; shoulders not being needed as the decoration is secured to the novelty by adhesive. Of course other means could be used.

Further, assemblies such as 36, 80 and 90 could be made in a large size and secured to automatic means for tipping them to cause movement of the shield so as to make an attractive, economical, commercial display.

As noted previously, the novelty decoration of the present invention for a novelty, or cigarette lighter or cover 10 has a number of advantages, some of which have been described above and others of which are inherent in the invention. Specifically, the decoration provides means for identifying an otherwise plain novelty to its owner. Also, the novelty appearing and disappearing image provides entertainment and a conversation piece for the user thereof. Many modifications can be made and equivalent structure used for the cigarette lighter cover or sleeve of the present invention without departing from the teachings thereof. Accordingly, the scope of the present invention should not be limited to merely what is disclosed and described as the preferred embodiment, but should be ascertained from the accompanying claims which should be broadly interpreted to include equivalent structures to that disclosed and described.

What is claimed is:

1. A novelty sleeve for a conventional, disposable cigarette lighter, comprising a body portion having a hollow interior space sized to receive the cigarette lighter, one end of said body portion being closed off to form a bottom end of said sleeve, the other end of said body portion being open to receive the cigarette lighter therein, image presenting means for said sleeve including a window housing for fitting on and extending at least part way through said sleeve, said window housing having at least one side made of clear material, a filmstrip with an opaque portion to provide a part of an image and a translucent portion providing the remainder of the image which is also caused to appear and disappear, said filmstrip being contained within said window housing, a dark background contained within said window housing and situated behind said translucent portion of the filmstrip, and a light color shield contained within said window housing and located between said filmstrip and said dark background, said shield being movable so as to enable the portion of the image defined by the translucent portion of the filmstrip to be caused to appear when said shield is moved therebehind and to disappear when the shield is moved away.

2. The sleeve according to claim 1, wherein said window housing is made of clear material and has an interior opening containing said filmstrip, shield and dark background.

3. The sleeve according to claim 1, further comprising at least one cap closing at least one end of said interior opening.

4. The sleeve according to claim 3, wherein said cap in turn has at least one opening and said interior of said window housing is adapted to be filled with a fluid through said opening in said cap.

5. The sleeve according to claim 4, wherein there are a pair of caps, each having an opening, and one of said openings in the caps is adapted to receive a light oil and the other opening in the caps is adapted to be connected to a vacuum for withdrawing air from said interior opening in said window housing, and plugs for closing said openings in said caps after the air has been withdrawn and the light oil added.

6. The sleeve according to claim 5, wherein said window housing, caps and plugs are also made of clear plastic.

7. The sleeve according to claim 1, wherein said window housing has a curved front wall, a rear wall and a pair of side walls, said filmstrip being held against the inside surface of said curved front wall by said side walls, said side walls having ridges thereon to hold said filmstrip spaced apart from said dark background, and said shield being slidably located between said filmstrip and dark background.

8. The sleeve according to claim 1, wherein said sleeve is of a cross-section complimentary to that of and sized to receive and hold the cigarette lighter.

9. The sleeve according to claim 1, wherein said bottom end of said sleeve has an opening therein to accommodate the cigarette lighter.

10. The sleeve according to claim 1, wherein said opaque portion of said filmstrip and dark background are black in color.

11. The sleeve according to claim 1, further comprising a light color background adjacent to said filmstrip and in front of said shield, said shield and light color background being white in color.

12. The sleeve according to claim 1, wherein said shield moves by gravity between a first position away from said translucent portion and a second position behind said translucent portion.

13. A sleeve as in claim 1, further comprising a light color background backing up said filmstrip to render a portion thereof opaque.

14. A sleeve as in claim 13, wherein said light color background is formed by coating the inside surface of said filmstrip.

15. A sleeve as in claim 14, wherein said light color background is silk-screened onto the inside surface of said filmstrip.

16. A novelty decoration for a novelty, comprising a window housing for fitting on and adapted to be affixed to the novelty, said window housing having at least one side made of clear material, a filmstrip with an opaque portion to provide a part of an image and a translucent portion providing the remainder of the image which is also caused to appear and disappear, said filmstrip being contained within said window housing, a dark background contained within said window housing and situated behind said translucent portion of the filmstrip, and a light color shield contained within said window housing and located between said filmstrip and said dark background, and means for affixing said window housing to said novelty located adjacent said one side made of clear material, said shield being movable so as to enable the portion of the image defined by the translucent portion of the filmstrip to be caused to appear when said shield is moved therebehind and to disappear when the shield is moved away, said window housing being adapted to be affixed to said novelty with said filmstrip being spaced further from said novelty than is said dark background.

17. The novelty decoration according to claim 1, wherein said window housing is made of clear material and has an interior opening containing said filmstrip, shield and dark background.

18. The novelty decoration according to claim 1, further comprising at least one cap closing at least one end of said interior opening, said cap having at least one opening, and said interior of said window housing is adapted to be filled with a fluid through said opening in said cap.

19. The novelty decoration according to claim 1, wherein there are a pair of caps, each having an opening, and one of said openings in the caps is adapted to receive a light oil and the other opening in the caps is adapted to be connected to a vacuum for withdrawing air from said interior opening in said window housing, and plugs for closing said openings in said caps after the air has been withdrawn and the light oil added.

20. The novelty decoration according to claim 19, wherein said window housing, caps and plugs are also made of clear plastic.

21. The novelty decoration according to claim 16, wherein said window housing has a curved front wall, a rear wall and a pair of side walls, said filmstrip being held against the inside surface of said curved front wall by said side walls, said side walls having ridges thereon to hold said filmstrip spaced apart from said dark background, and said shield being slidably located between said filmstrip and dark background.

22. The novelty decoration according to claim 16, wherein said means for affixing is double backed adhesive tape.

23. The novelty decoration according to claim 16, wherein said means for affixing is cement.

24. The sleeve according to claim 16, wherein said opaque portion of said filmstrip and dark background are black in color, and further comprises a light color background adjacent to said filmstrip and in front of said shield, said shield and light color background being white in color.

25. The sleeve according to claim 1, wherein said shield moves by gravity between a first position away from said translucent portion and a second position behind said translucent portion.

26. A sleeve as in claim 1, further comprising a light color background backing up said filmstrip to render a portion thereof opaque.

27. The novelty decoration according to claim 16, wherein said means for affixing comprises shoulders engaging in a corresponding portion on said novelty.

28. A novelty decoration for a novelty, comprising a window housing for fitting on and adapted to be affixed to the novelty, said window housing having an interior opening and at least one side made of clear material, filmstrip means for providing an image, said filmstrip means being contained within said window housing, with said filmstrip means being viewable through said one side, a pair of caps for closing opposite ends of said interior opening, each cap having an opening, and one of said openings in said caps being adapted to receive a light oil and the other opening in said caps being adapted to be connected to a vacuum for withdrawing air from said interior opening in said window housing, and a pair of plugs for closing said openings in said caps after the air has been withdrawn and the light oil added.

* * * * *